United States Patent [19]

D'Angelo et al.

[11] Patent Number: 4,991,482

[45] Date of Patent: Feb. 12, 1991

[54] APPARATUS AND METHOD FOR CUTTING RUBBER MATERIAL

[76] Inventors: Olivio D'Angelo, 315 Scarborough Beach Road, Innaloo; Mario Bosnar, 9 Pitino Court, Osborne Park, both of Australia

[21] Appl. No.: 86,090

[22] PCT Filed: Oct. 7, 1986

[86] PCT No.: PCT/AU86/00292

§ 371 Date: Aug. 20, 1987

§ 102(e) Date: Aug. 20, 1987

[87] PCT Pub. No.: WO87/02293

PCT Pub. Date: Apr. 23, 1987

[30] Foreign Application Priority Data

Oct. 15, 1985 [AU] Australia ..... PH2915

[51] Int. Cl.[5] ..... B26D 3/28

[52] U.S. Cl. ..... 83/874; 83/27; 83/102; 83/156; 83/169; 83/649

[58] Field of Search ..... 83/861, 870, 874, 161, 83/42, 53, 155, 156, 162, 27, 102, 169, 649; 69/15, 13; 156/584

[56] References Cited

U.S. PATENT DOCUMENTS

| | | | |
|---|---|---|---|
| 1,647,433 | 11/1927 | Callahan | 83/874 |
| 3,109,339 | 11/1963 | Braun et al. | 83/874 |
| 3,212,376 | 10/1965 | Berenbak et al. | 83/874 |
| 3,236,128 | 2/1966 | Holden | 83/874 |
| 3,733,997 | 5/1973 | Beasley | 83/874 X |
| 3,741,105 | 6/1973 | Beasley | 83/874 X |
| 3,747,448 | 7/1973 | Carbone | 83/874 |
| 3,780,605 | 12/1973 | Fingerle et al. | 83/874 |
| 4,143,565 | 3/1979 | Larson | 83/874 |
| 4,197,077 | 4/1980 | Kalvenes et al. | 83/870 X |
| 4,221,149 | 9/1980 | Dillinger | 83/870 |
| 4,491,498 | 1/1985 | Harris et al. | 156/497 |

*Primary Examiner*—Hien H. Phan
*Assistant Examiner*—Eugenia H. Jones
*Attorney, Agent, or Firm*—Harness, Dickey & Pierce

[57] ABSTRACT

A cutting apparatus for cutting a layer from a substrate length of rubber material such as used conveyor belting comprises a cutting station having a table with an upper surface to receive the material and a knife to cut the material. The cutting apparatus further comprises conveying rollers to convey the substrate length of material along the upper surface of the table and through the knife. The knife has a knife edge disposed in a plane generally parallel to and in spaced relation with the upper surface of the table to confront the material for cutting. The knife edge is arranged to extend in a transverse direction to the intended direction of passage of the material through the knife and is adapted to reciprocate in the transverse direction within the plane in conjunction with the conveyance of material through the knife to successively cut the layer from the material.

13 Claims, 4 Drawing Sheets

APPARATUS AND METHOD FOR CUTTING RUBBER MATERIAL

BACKGROUND OF THE INVENTION

This invention relates to an apparatus and method for cutting rubber material and more particularly for cutting a layer from a substrate length of rubber material. The invention has particular utility in obtaining lengths of rubber material from used conveyor belting which incorporates a layer of steel cords imbedded within a substrate rubber material and also in removing the top layer from such used conveyor belting for the purpose of recovering the belt.

Previous methods and apparatus for cutting a layer from a substrate length of rubber material have involved forcing the material through a fixed knife. Such a technique has met with little success in view of the inherent difficulties in cutting rubber material in a single skiving action. This arises principally as a result of the knife edge of the cutting blade producing a cut in the direction at which it is angled and the continuity of the cut in this direction in spite of attempts made to alter this cutting direction by re-alignment of the material. Consequently, once the cutting direction has gone askew, if the blade itself has not been re-aligned and external forces are applied upon the blade by the material itself to re-align the blade, a tremendous stress is created on the blade causing its eventual destruction. Accordingly, it is necessary to stop the cutting processing and re-position the blade to the desired attitude, immediately upon detecting that the cutting direction has gone askew.

Due to the obvious difficulties involved in precise positioning of the blade to obtain a constant thickness of cut and the necessity of re-aligning the blade to this position once the direction of cut has gone askew, such cutting operations have been limited to cutting conveyor belting having a reinforcing stratum of steel cords. By cutting such materials, it is possible to align the blade so that the knife edge causes a slightly depressed cutting direction so that the blade may encounter the steel cords and effectively run along the top of them to obtain a constant depth of cut. In this manner, the steel cords are sufficiently strong to prevent the knife from penetrating the stratum formed thereby and hence can effectively re-align the blade to cut at a constant depth. Such cutting operatiions, although possible, are still difficult to perform with using a fixed knife due to the limitation in the width of belting which may be cut in a single pass due to the large stresses experienced by the blade. Thus it is generally necessary to limit the cutting operation to conveyor belts of approximately ten to twenty centimeters in breadth. In situations where belts of greater breadth are required to be cut, it is necessary to run a number of passes of the belt through the cutting station enabling successive portions of the belt to be cut until its entire breadth has been cut.

It is an object of the present invention to provide an apparatus and method for cutting a layer from a substrate length of rubber material at a constant depth of cut without the need of stopping the cutting operation and re-aligning the knife edge of the cutting blade.

It is a preferred object of the invention to obtain selectively variable depths of cut independently of the location of a steel cord stratum within the substrate length of material to be cut.

SUMMARY OF THE INVENTION

In accordance with one aspect of the present invention, there is provided an apparatus for cutting layer from a substrate length of rubber material, said apparatus comprising:

a cutting station having a table with an upper surface to receive said material and knife means to cut said material; and conveying means to convey said substrate length of material along the surface of said table and through said knife means; and said knife means having a knife edge disposed in a plane generally parallel to and in spaced relation with the upper surface of said table to confront said material for cutting; and said knife edge being arranged to extend in a transverse direction to the intended direction of passage of said material through said knife means; and wherein said knife edge is adapted to reciprocate in said transverse direction within said plane in conjunction with the conveyance of material through said knife means to successively cut said layer from said material.

Preferably, said table comprises a fixed main frame to support said knife means and a sub-frame to support said upper surface, said sub-frame being adjustable in height relative to said main frame to facilitate varying said spacing.

Preferably, the conveying means comprises driving roller means disposed anteriorly and/or posteriorly of said knife means to respectively push and/or pull said material through said cutting station.

In accordance with another aspect of the present invention, there is provided a method for cutting a layer from a substrate length of rubber material comprising:

conveying said material to a cutting station along the upper surface of a table and through a knife means having a knife edge disposed in a plane generally parallel to and in spaced relation with said upper surface, such that said knife edge may confront said material for cutting; and cutting said material by reciprocating said knife edge within said plane transversely of the passage of said material through said cutting station.

The objects of the present invention are achieved by adopting such an apparatus and method which involves the reciprocation of the knife edge of the knife means, wherein the knife edge of the cutting blade automatically re-aligns itself upon each stroke of the reciprocating knife edge to produce a new cut. Thus a constant depth of cut may be obtained without the need for stopping the cutting operation.

BRIEF DESCRIPTION OF THE DRAWINGS

The invention will be better understood in the light of the following description of one specific embodiment thereof. The description is made with reference to the accompanying drawings, wherein.

DETAILED DESCRIPTION OF THE PREFERRED EMODIMENTS OF THE INVENTION

The first embodiment is directed to a cutting apparatus for cutting a layer from a length of substrate rubber material in the form of used conveyor belting having an inner core of steel cords imbedded therein.

Conveyor belting of this kind is usually discarded upon attaining some degree of wear on the conveying surface. Due to the presence of the steel cords therein, recycling of the belt has not found favour since it is difficult to extract the cords. In addition, reconditioning of the belt has not found favour due to the difficulty in cutting a layer from the belt. However, the present apparatus provides a means by which one or more layers or rubber may be cut from the belting leaving only the core stratum of the belting comprising the matrix of steel cord, if desired.

Figure 2:
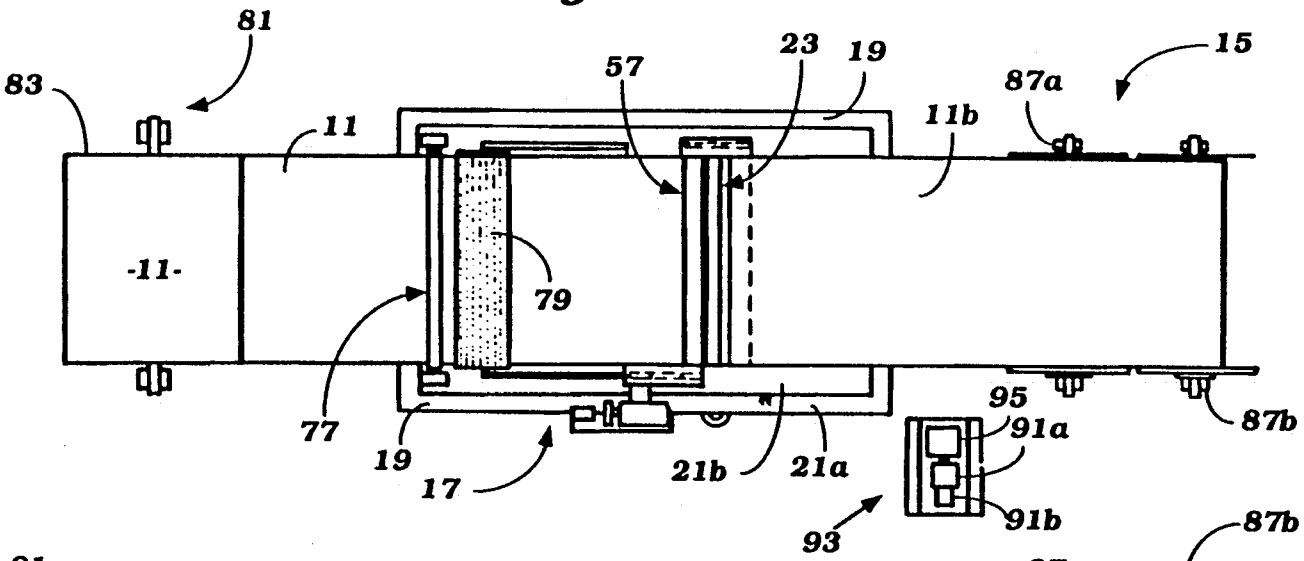
FIG. 2 is a top view of FIG. 1.
Figure 1:
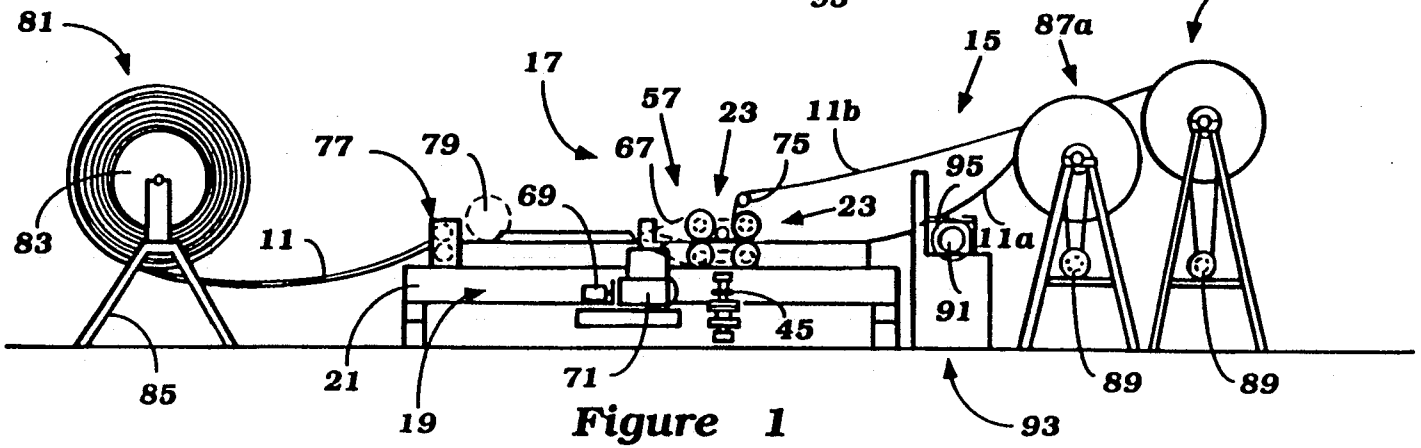
FIG. 1 is a side elevation of the cutting apparatus.
Figure 7:
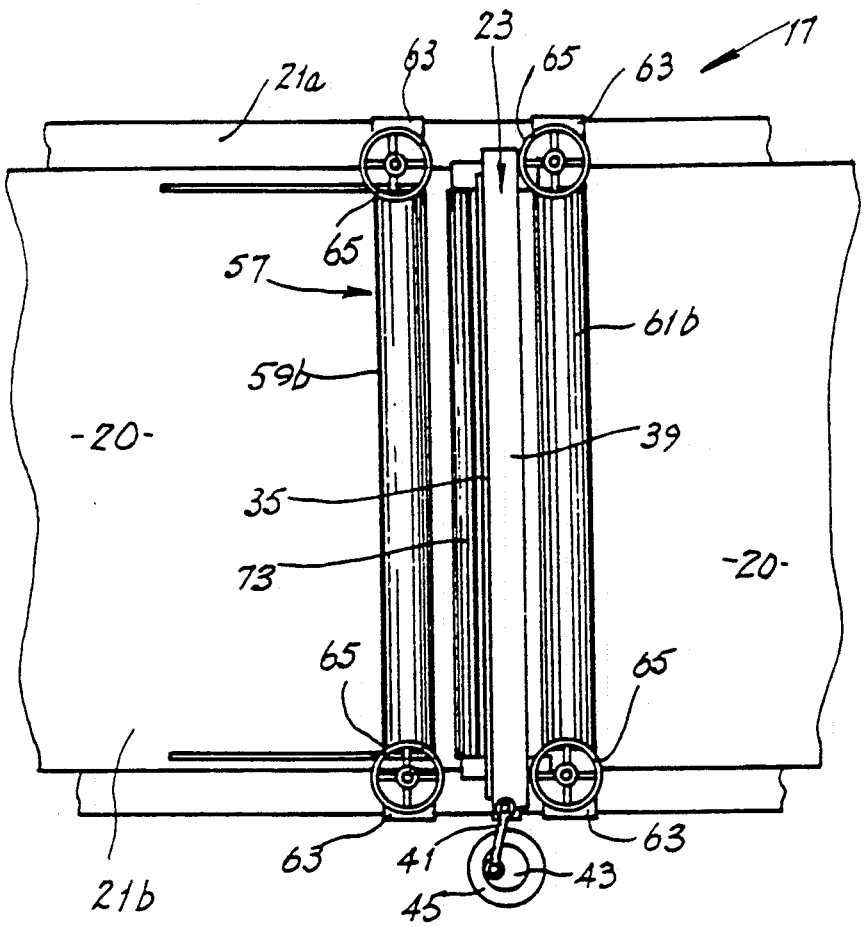
FIG. 7 is a plan view showing the detail of the cutting station proximate the knife means with the belt removed.
Figure 8:
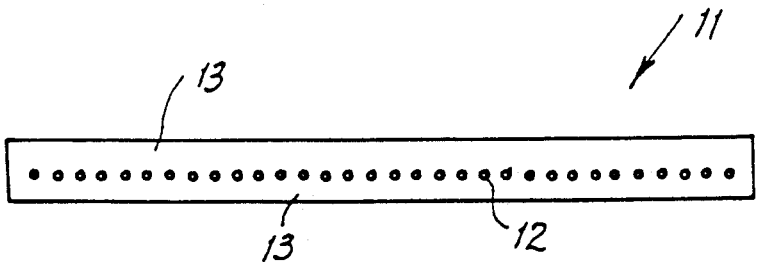
FIG. 8 is a cross-sectional view of rubber belting having an inner core of steel cords.
Figure 5:
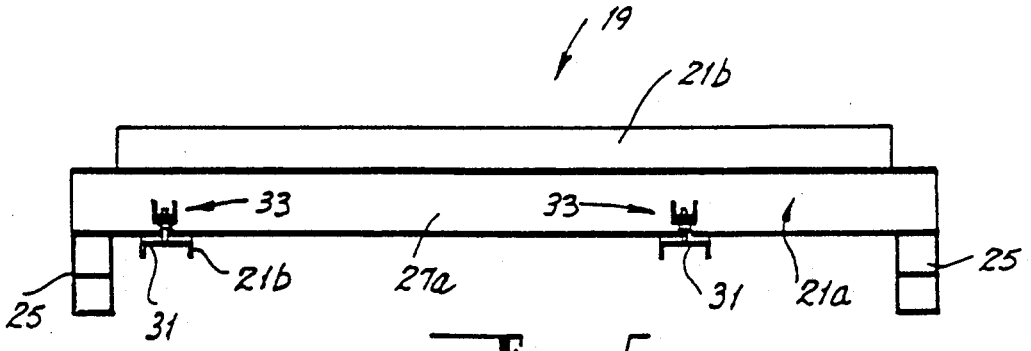
FIG. 5 is a side elevation of the main and sub-frames of the table.
Figure 6:
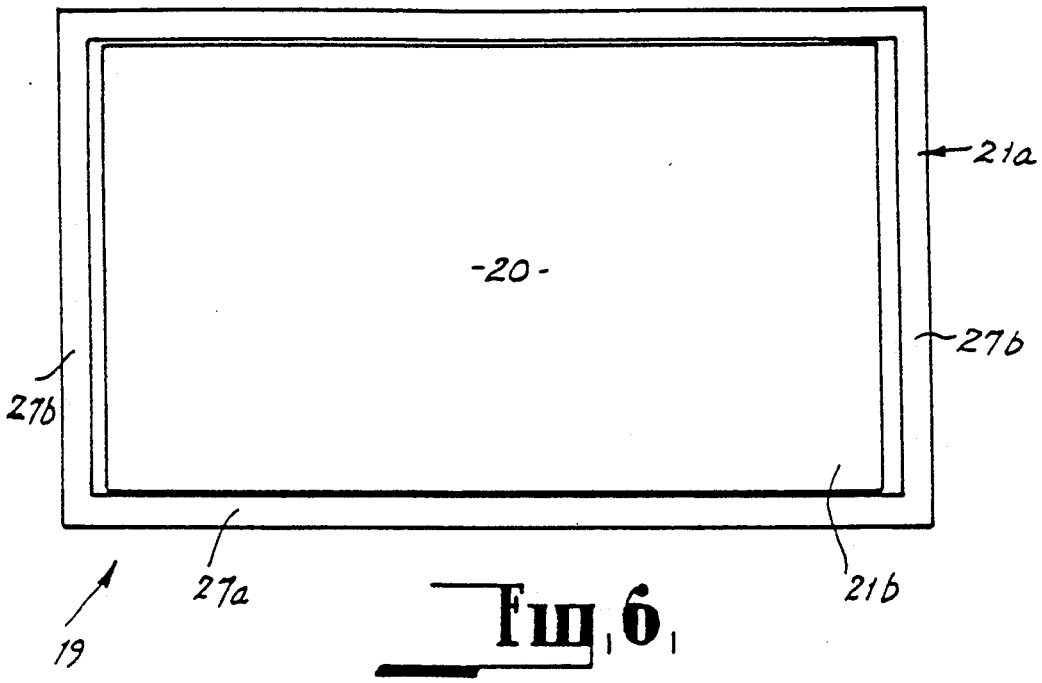
FIG. 6 is a plan view of FIG. 5.

A cross-sectional view of the rubber belting 11 is shown at FIG. 8, wherein the matrix of steel cords 12 is imbedded within a substrate of rubber material 13. As can be seen from this cross-section, a layer of rubber material may be cut or skived from the belting either side of the matrix of steel cords.

The cutting apparatus 15 generally consists of a cutting station 17 and a conveying means.

The cutting station 17 has a table 19 with a rectangular planar upper surface 20 mounted within a supporting frame work 21 and a knife means 23. In the present embodiment, the frame work 21 is formed of two parts, a main frame 21*a* and a sub-frame 21*b*.

The main frame 21*a* is provided with pairs of supporting legs 25 and a rectangular box frame 27 supported thereon, which is disposed in a generally horizontal plane spaced from the ground. The box frame 27 is formed with a pair of longitudinal supporing beams 27*a* and a pair of transverse supporting beams 27*b* which house the sub-frame 21*b*. The sub-frame 21*b* is provided with two pairs of vertical struts (not shown) spaced apart longitudinally which support the rectangular upper surface 20 of the table near each of its corners. The bottoms of the struts each have a laterally extending foot member 31 mounted thereto which projects outwardly from the sub-frame to be disposed beneath the underside of an adjacent longitudinal supporting beam 27*a*. Each foot member is provided with an upwardly projecting threaded shank portion which is attached to a co-operating anchor bracket provided at the side of each longitudinal supporting beam 27*a* by an adjustable nut to form an anchoring point 33.

Accordingly, the height of the sub-frame and hence the upper surface of the table may be adjusted relative to the main frame by adjusting the nuts provided at each of the anchoring points 33 of the framework 21. The knife means 23 is mounted transversely to the main frame to span the breadth of the pathway defined by the table surface 20.

The knife means 23 comprises an elongate blade 35 provided with a serrated knife edge 37, and a blade supporting bar 39. The supporting bar 39 extends marginally beyond the breadth of the pathway and has a connecting rod 41 pivotally connected at one end thereto. The connecting rod 41 is in pivotally connected to a disc crank 43 mounted to a vertical drive shaft of a hydraulic motor 45.

Accordingly, rotation of the drive shaft causes cranking movement of the connecting rod which in turn reciprocates the supporting bar in a transverse direction across the pathway. In the present embodiment the size of the disc crank is sufficient to provide a reciprocating stroke length of 100 millimeters.

Figure 4:
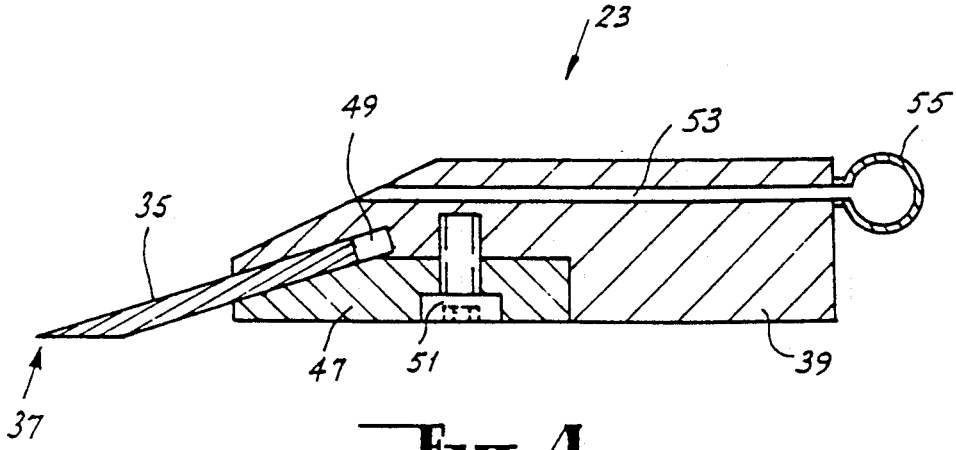
FIG. 4 is a cross-sectional side view showing the detail of the knife means.

The supporting bar 39 is formed with a longitudinal recess at its underside at the front thereof to accommodate the blade 35 and a complementary clamping strip 47, as shown at FIG. 4 of the drawings. The recess is provided with an obliquely aligned inner slot 49 which receives the back of the blade and angles the blade at a slightly depressed attitude forwardly of the bar. The blade 35 is clampingly retained within the slot by bolting the clamping strip 47 into the recess of the bar by means of the bolt 51 positioned at the underside of the bar such that the knife edge 37 is disposed in a plane generally parallel to and in spaced relation with the upper surface of the table. It should be noted that the clamping strip 47 is particularly shaped to complement the recess of the bar and the bolt 51 is countersunk so that the underside of the bar is flat in the completed arrangement to facilitate passage of cut rubber material under the bar.

The knife edge 37 of the blade 35 is formed with a bevelled edge such that the bevelled face is disposed in a plane parallel with the underside of the bar and parallel with the direction of passage of the substrate length of rubber material along the table through the knife means. It should be noted that the depressed projection of the blade is such that the knife edge 37 resides at a location below the underside of the bar to enable sharpening of the edge of the blade from its bevelled side whilst it is clamped to the bar. Thus the bar and blade assembly can be removed from its working position as a composite unit, the unit inverted and the sharpening operation proceeded with without removal of the blade itself from its clamped position.

The bar 39 is also formed with a series of integral fluid conducting passages 53 which extend from the back of the bar to a location disposed immediately above the upper surface of the blade 35. The passages 53 are located at spaced intervals along the bar and communicate with a duct 55 disposed transversely along the rear of the bar to conduct lubricating fluid under pressure to the knife edge, without interfering with the cutting operation. The duct 55 is connected to a fluid reservoir (not shown) to supply fluid to the passages. The fluid is preferably a liquid detergent which functions as a coolant as well as a lubricant to promote cutting by the knife edge.

The conveying means comprises driving roller means 57 disposed anteriorly and posteriorly of the knife means 23 to respectively push and pull the belting material through the knife means along the upper surface of the table. In alternative arrangements, the conveying means may comprise a single anterior driving roller means which only pushes the material through the knife means or a single posterior driving roller means which only pulls the material through the knife means. Obviously these arrangements are not as efficient as the combined arrangement.

The driving roller means consists of a pair of rollers in each case, i.e. anterior rollers 59 and posterior rollers 61, wherein the rollers of a pair are vertically aligned in spaced apart relation to each other to define a nip in the pathway of the cutting station. In the present embodiment, the bottom rollers 59*a*, 61*a* of each pair are mounted to the sub-frame below the upper surface of the table. The upper surface of the table is accordingly provided with a pair of transversely disposed openings, where one opening is aligned with the anterior rollers 59 and the other opening is aligned with the posterior rollers 61.

The bottom rollers 59*a*, 61*a* are mounted such that the top portions of each project through the respective openings to contact the underside of the belting and convey it through the knife means by pushing or pulling, where appropriate. The rollers 59*b*, 61*b* are independently mounted to adjustable supports 63 provided on the main frame, which include spring biasing means (not shown), adjustable by circular handles 65, to provide a compressive force downwardly on the upper surface of the belting at the nip defined with the corresponding bottom rollers. This compressivee force is selected to enable the rollers to impose sufficient friction on the belting so that it may be forced through the knife means.

Although in the present embodiment the bottom rollers are mounted to the sub-frame, and the top rollers are mounted to the main frame it is possible for both sets of rollers to be mounted to the sub-frame. The mounting of the bottom rollers to the sub-frame has the desirable effect that height adjustment of the upper surface of the table by means of the sub-frame automatically adjusts the height of the rollers relative to the knife means, and hence facilitates setting of the depth of cut into the belting.

The top and bottom rollers are respectively connected by a chain drive mechanism 67 to another hydraulic motor 69 via a reduction gear box 71. Accordingly, all of the rollers are driven synchronously at the same speed to feed the belting through the knife means at a constant speed.

In order to maintain the underside of the belting in contact with the upper surface of the table, and enable the belt to be fed to the knife means at an even height the conveying means includes a transverse leading idler guiding roller 73 disposed adjacent to the anterior of the means in pressing engagement with the top of the belting. The leading guiding roller 73 is mounted at either end to the main frame 21*a* by means of a pivotal arm assembly (not shown) which is capable of forcing the guiding roller downward to engage the top of the belting adjacent the knife edge and being clamped at this position to maintain this engagement. Consequently, the belting is pressed to intimately contact the upper surface to the table as it is fed through the knife means. In this manner, any elevation of the belting from the table surface caused by the anterior bottom roller 59*a*, is compensated for prior to being cut by the knife means.

It should be apparent that in order to adjust the thickness of cut by the knife means, it is simply necessary to adjust the height of the sub-frame relative to the main frame at the anchoring points, the adjust the leading guiding roller 73 to maintain the downward force on the belting near knife edge.

Figure 3:
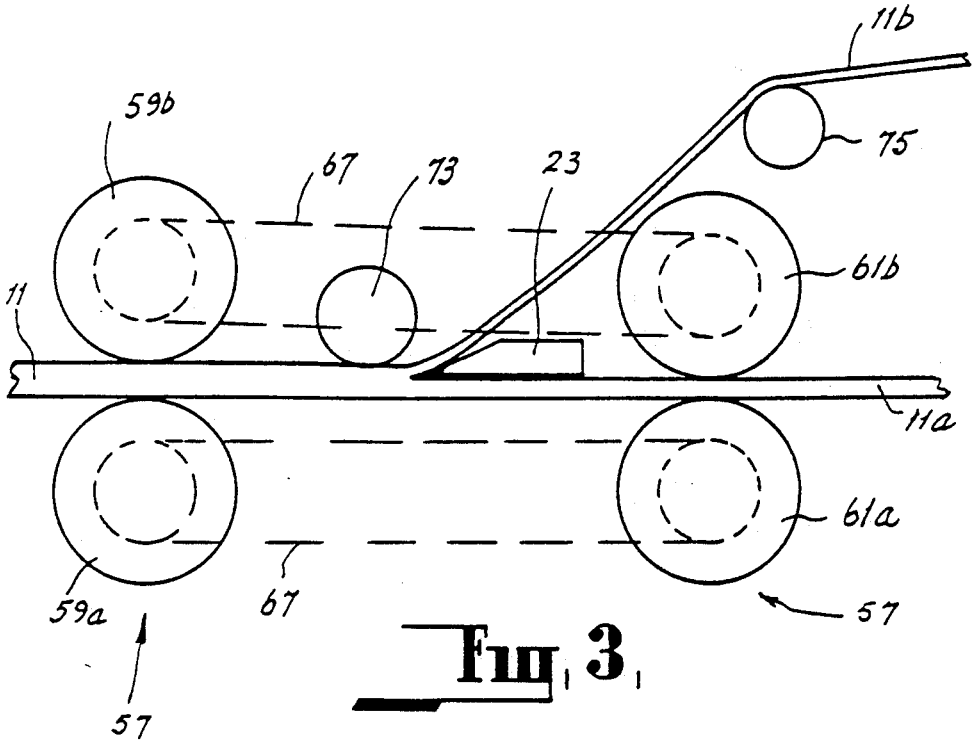
FIG. 3 is a side schematic view showing the essential components of the cutting station proximate the knife means, without frame and table of the apparatus.

To facilitate the cutting operation, the conveying means is also provided with a transverse trailing idler guiding roller 75 disposed rearwardly of the knife means and in an elevated position relative to the table surface, as shown at FIG. 3 of the drawings. The trailing guiding roller 75 is provided to force the layer cut by the knife means to pass over its upper surface and hence continuously biases the cut layer away from the knife edge assisting separation from the remaining substrate length. Consequently less stress is placed on the knife means by minimising its contact and friction with the cut layer during cutting.

Disposed forwardly of the framework 21 are a pair of vertically disposed guide rollers 77 which are arranged to guide a length conveyor belting to the table of the cutting station 17. A rotatable brush roller 79 is mounted adjacent the guide rollers 77 to scour the upper surface of the belting on its passage to the cutting station prior to the driving roller means. The brush roller is driven at relatively high revolutions by an electric motor (not shown).

The conveying means also includes a delivery reel 81 located forwardly of the cutting station 17. The reel 81 is in the form of a detachable drum 83 mounted to a supporting framework 85. The drum 83 allows for coiling of long lengths of the conveying belting 11 upon the spool thereof for delivery to the cutting station. The reel may be motorised with a facility for free-wheeling to allow the belting to be supplied unhindered to the cutting station under the control of the driving roller means. By having a detachable drum 83, it is possible to store a number of lengths of conveyor belting on separate drum, allowing these to be alternatively attached to the supporting framework 85 for delivery to the cutting station.

The conveying means further includes a pair of take-up reels 87*a*, 87*b* positioned in sequence rearwardly of the cutting station 17 to respectively coil the cut layer and remaining substrate of the belting after passage through the knife means. The first take-up reel 87*a* accepts the remaining substrate 11*a* of the belting from the posterior driving roller means 61 at the rear end of the table. The second take-up reel 87*b* is positioned behind and at a slightly elevated position relative to the first take-up reel 87*a* to accept the cut layer 11*b* of the belting from the trailing guide roller 75. Both take-up reels are motorised being driven severally by independently operable electric motors 89 to facilitate coiling of the belting when desired.

The hydraulic motors 45 and 69 for the knife means and driving roller means respectively, are separately coupled to respective hydraulic pumps 91 via a control station 93. The first pump 91*a* is connected to the hydraulic motor 45 and has a working capacity of 24 gallons per minute which is capable of operating the motor at 300 revolutions per minute (rpm) maximum, but optimally at 250 rpm with a capacity of 19 gallons per minute. These speeds drive the knife means at a cutting rate of 50 meters per hour maximum, and 27 meters per hour optimum. On the other hand the second pump 91*b* has a much smaller capacity of 6 gallons per minute, but actually operates at only 1 gallon per minute. This drives the motor 69 at a speed of 160 rpm which is geared down by virtue of the reduction gear box 71 to feed the belting at the optimum rate of 27 meters per hour and deliver relatively high torque to the driving rollers to facilitate pushing and pulling of the belting through the knife means.

Both pumps 91 are coupled to a common drive shaft which is driven by a 12 horsepower electric motor 95.

The control station 93 includes conventional control devices for regulating the flow of hydraulic fluid in the hydraulic system, thereby enabling variable control of the motor speeds for the knife means and driving roller means.

The operation of the cutting apparatus shall now be described.

Initially, a drum 83 bearing a coiled length of conveyor belting thereon is positioned on the supporting framework 85 of the reel 81 and fed via the guiding rollers 77 and brush roller 79 to the cutting station 17. At the cutting station, the belting 11 is passed along the upper surface 19 of the table and through the nip of the anterior driving rollers 59 to the knife means 23. The thickness of cut desired can then be set by adjusting the height of the table surface on the sub-frame relative to the knife edge of the knife means on the main frame. As previously described, this is effected by adjusting the nut at the anchoring points 33 of the framework 21. Subsequently, the leading idler guiding roller 73 may be clamped into pressing engagement with the belting adjacent the knife edge.

In order to commence cutting of the belting, the knife means is operated to reciprocate at any appropriate speed which may relatively slow initially, e.g. 12 strokes per minute, to enable the initial incision into the transverse edge of the belting to be made. During this time the anterior driving roller means 59 is operated to slowly feed the belting into the path of the knife edge.

An important advantage of the present invention over the prior art can be appreciated at this stage, where the thickness of the layer to be cut from the belting can be of any desirable amount. That is, it is not necessary to adjust the height of the table so that the knife edge always cuts the belting precisely along the top of the steel cord stratum. For instance, it is quite permissible to adjust the table so that only the finest sliver of material is taken off by the knife means from the upper surface of the belting. Furthermore it is quite permissible for a layer to be cut continuously where the knife edge actually emerges from the belting at some depressed point of the surface of the belting and re-enters the belting at some location further along the surface where the surface of the belting returns to its normal height.

After the initial incision into the belting is made and the operator is quite satisfied at the thickness of the cut, the hydraulic motors can be adjusted to optimum speed and the cutting operation proceeded with until a sufficiently long portion of the belting is cut to enable the cut layer to be fed over the trailing idler guiding roller 75 and the remaining substrate fed through the posterior driving roller means. After a further long portion of the belting is cut sufficient to reach the take-up reels 87, the cut layer 11*b* and remaining substrate 11*a* may be wound upon the reels 87*b* and 87*a* respectively for coiling. The reels may be rotated by operating the motors 93 thereof at selected intervals thereafter to coil the cut belting thereon.

Both sides of the conveyor belting may be cut by the apparatus if desired by simply exchanging the drum on the take-up reel 87*a* after finishing one pass of the belting through the cutting station, with the drum on the delivery reel and repeating the aforementioned operation again with substrate length of material reversed to exposed the uncut side of the belting to the knife means for cutting.

The principal advantages provided by the present invention over the prior art are conferred by adopting a reciprocating knife means where a new cut of the rubber belting is effected at each and every stroke of the knife means. Consequently, there is no opportunity for the cut which is effected to go askew in direction as a new cut in the desired direction is performed at each stroke of the knife means. This in itself produces another desirable feature in that the cut surface of the belting has engraved therein a series of regularly spaced score marks indicative of the separate cuts effected in the belting at each stroke of the knife means. These score marks have the desirable feature of providing a decorative surface to the cut layer, and also providing a roughened surface which is more conductive to a painting than a smooth surface.

A further advantage of the present invention is that by adopting both anterior and posterior driving roller means feeding of the belting through the knife means is enhanced. In the case of the anterior driving roller means, the belting can be pushed through the knife means and cutting commenced automatically without the need of manually forming the first incision, peeling back a sufficient length of cut layer from the remaining substrate, and feeding the cut belting through to same pulling mechanism to commence the cutting operation. In the case of the posterior driving roller means, relatively thin lengths of belting may have layers cut therefrom by pulling the belting through the knife means thereby avoiding buckling of the belting at the knife edge which would otherwise arise from merely pushing the belting through. Consequently, this provides the present apparatus with more versatility than prior art machines.

Another advantage of the present invention is that a layer of rubber material may be cut from the substrate in a single run of the belting through the cutting station at a relatively quick speed without excessive stress being imposed on the knife means. Furthermore, by adopting a reciprocating action, it is possible to cut widths of conveying belting in the transversing direction in excess of 900 millimeters, which in prior art arrangements simply could not be attained in a single pass of the belting through the cutting station.

It should be appreciated that the scope of the present invention is not limited to the scope of the specific embodiment herein described. Particularly, it should be noted that the specific arrangement of the conveying means is not limited to the precise pushing and pulling arrangements described herein but may involve pushing or pulling of the material per se.

Furthermore, the invention is not limited to the hydraulic type of power means described herein, but can include other types of power means, such as electric or pneumatic systems.

In addition, it should be appreciated that variations and modifications to the apparatus which would be apparent to a skilled worker in the field of the invention are deemed within the scope of the present invention.

We claim:

1. A method for cutting a layer of rubber from a substrate length of rubber material reinforce by a rigid core, employing an apparatus comprising a cutting station having a table with an upper surface to receive said material and knife means to cut said material; conveying said substrate length of material along the surface of said table and through said knife means; pressing said substrate into engagement with said table adjacent and ahead of said knife means in the direction the length of material is conveyed, said knife means having a knife edge disposed in a plane generally parallel to and in spaced relation with the upper surface of said table to confront said material for cutting; said knife edge being arranged to extend in a transverse direction to the conveyed direction of said material through said knife means; the knife means being supported for reciprocation in said transverse direction, and reciprocating said knife edge in said transverse direction within said plane upon the conveyance of material through said knife means to successively cut said layer from said material.

2. A method as claimed in claim 1, wherein the thickness of the layer cut is adjusted by adjusting the height of the upper surface of said table relative to said knife edge to selectively vary the spacing therebetween.

3. A method as claimed in claim 2, wherein said table comprises a fixed main frame supporting said knife means and a sub-frame supporting said upper surface, said sub-frame being adjustable in height relative to said main frame to vary the thickness of the cut.

4. A method as claimed in claim 3, wherein the conveying is accomplished by a driving roller means disposed on one side of said knife means for conveying said material through said cutting station.

5. A method apparatus as claimed in claim 4, wherein said driving roller means are mounted to said sub-frame.

6. A method as claimed in claim 1, wherein the substrate is pressed to the table by a leading idler guiding roller disposed adjacent to the anterior of the knife means in closely spaced relation to the knife edge for providing the downward pressing force on said material as it passes through knife means, thereby maintaining the underside of said material in contact with the upper surface of said table.

7. A method as claimed in claim 1, the apparatus includes a trailing idler guiding roller disposed rearwardly of said knife means and in an elevated disposition relative to the upper surface of said table so that the layer cut from said material will pass over said trailing roller after cutting thereof for separation from said material during cutting by continuously biasing the cut layer away from the knife edge and to facilitate take-up of said layer separately from the remaining material.

8. A method as claimed in claim 1 wherein material is coiled on a delivery reel for delivery to said cutting station.

9. A method as claimed in claim 1, wherein the apparatus includes a pair of take-up reels which respectively coil said layer and said remaining substrate length of material, severally, after passage through said cutting station.

10. A method as claimed in claim 1, wherein said knife means comprising an elongate blade upon which is provided said knife edge, and a blade supporting bar, said bar being adapted to accomodate said blade in clamped relation thereto such that said blade may extend forwardly from said bar at a slightly depressed attitude thereto to present said knife edge to said material at a transverse line of contact forwardly from said bar and at a position marginally lower than the underside of said bar.

11. A method as claimed in claim 10, further including the step of conducting lubricating fluid under pressure from a duct disposed rearwardly of the bar to a series of location disposed immediately above the upper surface of the blade for supplying lubricating fluid to said knife edge without interference to the cutting operation.

12. A method as claimed in claim 1, wherein the lower surface of said knife edge is disposed to be generally parallel to said upper surface of the table.

13. A method as claimed in claim 1, wherein said knife edge is serrated.

* * * * *

UNITED STATES PATENT AND TRADEMARK OFFICE

CERTIFICATE OF CORRECTION

PATENT NO. : 4,991,482

DATED : February 12, 1991

INVENTOR(S) : D'Angelo, et al

It is certified that error appears in the above-identified patent and that said Letters Patent is hereby corrected as shown below:

Column 8, line 57, Claim 1, "reinforce" should be --reinforced--.

Column 9, line 21, Claim 5, delete "apparatus".

Column 10, line 5, Claim 8, after "wherein" insert --the--.

Column 10, line 14, Claim 10, "comprising" should be --comprises--

Column 10, line 16, Claim 10, "accomodate" should be --accommodate--

Column 10, line 20, Claim 10, after "contact" insert --spaced--.

Column 10, line 26, Claim 11, "location" should be --locations--.

Signed and Sealed this

Twenty-seventh Day of April, 1993

*Attest:*

MICHAEL K. KIRK

*Attesting Officer*

*Acting Commissioner of Patents and Trademarks*